US006571711B1

(12) United States Patent
Bostrack

(10) Patent No.: US 6,571,711 B1
(45) Date of Patent: Jun. 3, 2003

(54) PRINT CYLINDER COOLING SYSTEM

(75) Inventor: Daniel Bostrack, Pine, CO (US)

(73) Assignee: Air Motion Systems, Inc., Golden, CO (US)

( * ) Notice: Subject to any disclaimer, the term of this patent is extended or adjusted under 35 U.S.C. 154(b) by 119 days.

(21) Appl. No.: 09/699,987

(22) Filed: Oct. 27, 2000

Related U.S. Application Data

(60) Provisional application No. 60/162,594, filed on Oct. 29, 1999.

(51) Int. Cl.[7] ..... B41F 5/06

(52) U.S. Cl. ..... 101/487; 101/216

(58) Field of Search ..... 101/487, 483, 101/484, 230; 34/391; 165/110

(56) References Cited

U.S. PATENT DOCUMENTS

| | | | | |
|---|---|---|---|---|
| 3,686,771 A | * | 8/1972 | Schone et al. | 101/230 |
| RE28,758 E | | 4/1976 | Decker | |
| 4,456,629 A | | 6/1984 | Wood et al. | |
| 4,482,387 A | | 11/1984 | Wood et al. | |
| 4,501,072 A | * | 2/1985 | Jacobi, Jr. et al. | 219/347 |
| 4,642,126 A | | 2/1987 | Zador et al. | |
| 4,653,940 A | | 3/1987 | Katsukawa | |
| 4,797,837 A | | 1/1989 | Brooks | |
| 4,811,493 A | * | 3/1989 | Burgio, Jr. | 34/268 |
| 4,983,852 A | * | 1/1991 | Burgio, Jr. | 250/504 |
| 5,148,742 A | | 9/1992 | Stirbis et al. | |
| 5,152,619 A | | 10/1992 | Niikawa et al. | |
| 5,506,608 A | | 4/1996 | Marler et al. | |
| 5,537,133 A | | 7/1996 | Marler et al. | |
| 5,619,927 A | * | 4/1997 | Winheim | 101/487 |
| 5,675,370 A | | 10/1997 | Austin et al. | |
| 5,731,881 A | | 3/1998 | Buechler | |
| 5,832,833 A | * | 11/1998 | Burgio | 101/487 |
| 5,881,647 A | | 3/1999 | Siler et al. | |
| 5,981,022 A | * | 11/1999 | Min et al. | 34/391 |
| 6,010,587 A | | 1/2000 | Hsia | |
| 6,025,861 A | | 2/2000 | Austin et al. | |
| 6,076,466 A | | 6/2000 | Siler et al. | |
| 6,099,406 A | * | 8/2000 | Demster | 454/236 |
| 6,125,759 A | * | 10/2000 | Van Epps | 101/484 |
| 6,142,219 A | * | 11/2000 | Korenic et al. | 165/110 |

FOREIGN PATENT DOCUMENTS

| | | |
|---|---|---|
| EP | 0 652 104 A1 | 2/1995 |
| EP | 0 638 418 A1 | 5/1995 |

OTHER PUBLICATIONS

European Search Report dated Mar. 22, 2001.

* cited by examiner

*Primary Examiner*—Eugene H. Eickholt
(74) *Attorney, Agent, or Firm*—Patterson, Thuente, Skaar & Christensen, P.A.

(57) ABSTRACT

A cooling system for a sheet-fed printing unit, including at least one fan and a cooling element such as a chilled water coil. The printing unit includes a plurality of ink cylinders, a blanket cylinder, an impression cylinder, and one or more transfer cylinders. A source directs radiant energy onto substrate being printed to cure ink thereon. The radiant energy may be directed at substrates on the impression or transfer cylinders. In response to the radiant energy, the impression or transfer cylinders become heated and transfer heat to the substrate, which distorts as a result. The fan generates an airflow toward an impression or transfer cylinder. The airflow is within a predetermined temperature range and of a sufficient magnitude to maintain the impression or transfer cylinder within a critical temperature range to prevent or minimize substrate distortion.

35 Claims, 2 Drawing Sheets

PRINT CYLINDER COOLING SYSTEM

CROSS-REFERENCES TO RELATED APPLICATIONS

This application claims priority under 35 U.S.C.§119 (e) to, and hereby incorporates by reference, U.S. Provisional Application No. 60/162,594, filed Oct. 29, 1999.

BACKGROUND OF THE INVENTION

1. Field of the Invention

This invention relates to sheet-fed printing presses and, in particular, this invention relates to an apparatus and a method to cool printing press cylinders, such as impression cylinders and transfer cylinders, and substrates being printed thereon.

2. Background of the Invention

Sheet-fed printing presses use such processes as lithographic, flexographic, and gravure printing to transfer images to a substrate such as plastic or paper. The sheet substrate is usually conveyed through the printing press by a series of rotating transfer and impression cylinders (collectively transfer elements). The image is usually transferred by depositing liquid or paste ink onto the substrate from a blanket cylinder, raised image plate, or gravure cylinder to the impression cylinder while the substrate is positioned between surfaces of the blanket cylinder and the impression cylinder. After being printed, the image of liquid or paste ink (or coating) may be dried or cured by radiant energy. The radiant energy is usually directed at the newly printed substrate while the substrate is positioned over the surface of the impression or transfer cylinder. Thus, both the substrate and printing cylinders absorb heat. Some of the heat cures the ink and raises the temperature of the substrate, which is conveyed away from the radiation site. Some of the heat absorbed by the printing cylinders is dissipated by radiation. However some of the heat absorbed by the printing press cylinders raises the temperatures of these elements and is then transferred to substrates. The heated substrates respond to this heat transfer by distortion (e.g., expansion and contraction).

The typical finished printed image is actually a mosaic of several component images deposited sequentially by multiple printing units. Thus, each printing unit adds to the final image. For example, an image with a blue background on white paper and with red lettering requires exact spaces left blank for the red lettering. Each component image must be transferred to an exact position on the substrate. For example, between about 133 and 600 lines per inch are from common registration criteria. If the substrate expands or contracts during the printing process, a phenomenon known as thermal distortion occurs and component images are not transferred to exact positions. When this occurs the finished product is often blurred or distorted. The above-mentioned substrate distortion, therefore, is a result of substrate heat absorption via the curing process and of printing press cylinders operated at temperatures above a critical temperature range.

Thus far, cylinders in printing units have been maintained within desired temperature ranges by utilizing cool air ducted into the press from an external air conditioning unit. Maintaining the cylinder temperatures by this method is expensive, inefficient, and often ineffective. These prior art temperature control systems require large amounts of energy to cool air from ambient temperatures, to often as low as 35 degrees F. Moreover and due to space constraints within the printing press, the ducts often cannot be installed so as to direct cool air to all printing surfaces, which are being operated at elevated temperatures. Because these ducted systems often fail to cool all printing cylinders, the final product is frequently flawed by thermal distortion.

There is then a need for an apparatus and a method for quickly and efficiently maintaining printing cylinders within temperature ranges which will not cause substrate distortion. There is a particular need for an apparatus and a method to economically and effectively maintain printing press cylinders at temperatures (e.g., below 100 degrees F) to insure that an optimum quality printed product is achieved.

SUMMARY OF THE INVENTION

This invention substantially meets the aforementioned needs of the industry by providing a printing system, the printing system including a blanket cylinder, transfer elements such as impression (printing) cylinders and[]transfer cylinders, and a unit for directing an airflow at the impression. The present airflow temperature range may be a temperature, which will effectively prevent the substrate from being thermally distorted beyond a specified limit. The effective airflow temperature may also be below a maximum acceptable temperature of the transfer element. Under certain circumstances, the present effective airflow temperature may be between slightly above 32 degrees F. (e.g., 34 degrees F.) and 120 degrees F.; between 40 degrees F. and 75 degrees F., or between 50 degrees F. and 55 degrees F.

The cooling unit may include at least one fan and at least one cooling coil, the cooling coil positioned to cool air directed by the fan at the transfer element. The cooling coil may convey a coolant such as a chilled liquid or a compressible gas. The cooling unit may further include a temperature sensor in electrical communication with the fan for measuring a transfer element temperature. The sensor may be an infrared, noncontact sensor. The present invention may further include a control unit in electrical communication with the sensor, the fan, and a pump or valve. The control unit activates the fan and the pump or valve when the transfer element is heated to a designated temperature, the designated temperature detected by the sensor. The pump or valve then circulates coolant through the cooling coil.

There is further provided a process for maintaining a transfer element within a designated temperature range, the process including providing a cooling system and directing an airflow at the transfer element. The cooling system may include at least one fan and a cooling coil. The airflow may be cooled by the cooling coil and generated by the fan. The cooling coil may convey a refrigerant such as chilled water or a compressible gas.

There is yet further provided a process of installing a cooling unit for a printing cylinder, the process including providing the cooling unit and positioning the cooling unit so as to direct an airflow at a transfer element. The cooling unit may include at least one fan, a cooling coil, and a pump or valve. The fan may generate an airflow, which is cooled by the cooling coil and directed at the transfer element. The pump may circulate a cooling fluid through the coiling coil.

An object of this invention is to provide an apparatus to maintain a transfer element within a temperature range effective to ensure that substrate distortion is within allowable limits.

Another object of this invention is to retrofit a printing assembly with an apparatus to maintain transfer elements therein within an effective or desired temperature range.

It is an advantage of this invention that transfer element temperatures can be maintained within desired temperature ranges with less energy than was previously possible.

It is another advantage of this invention that each transfer element can be maintained within a desired temperature range notwithstanding space limitations within the printing press unit.

It is yet another advantage of this invention that each transfer element can be maintained within a desired temperature range without the expense and effort previously required to install air ducts.

Additional objects, advantages, and features of various embodiments of the invention will be set forth in part in the description which follows, and in part will become apparent to those skilled in the art upon examination of the following or may be learned by practice of the invention. The objects and advantages of various embodiments of the invention may be realized and attained by means of the instrumentalities and combinations particularly pointed out in the appended claims.

DETAILED DESCRIPTION OF THE INVENTION

A typical printing press includes many separate printing units. Each unit sequentially deposits ink or another printing medium such as coating materials on a sheet substrate such as paper or plastic. Thus, a finished printed product is the result of numerous images sequentially deposited by printing units.

Figure 1:
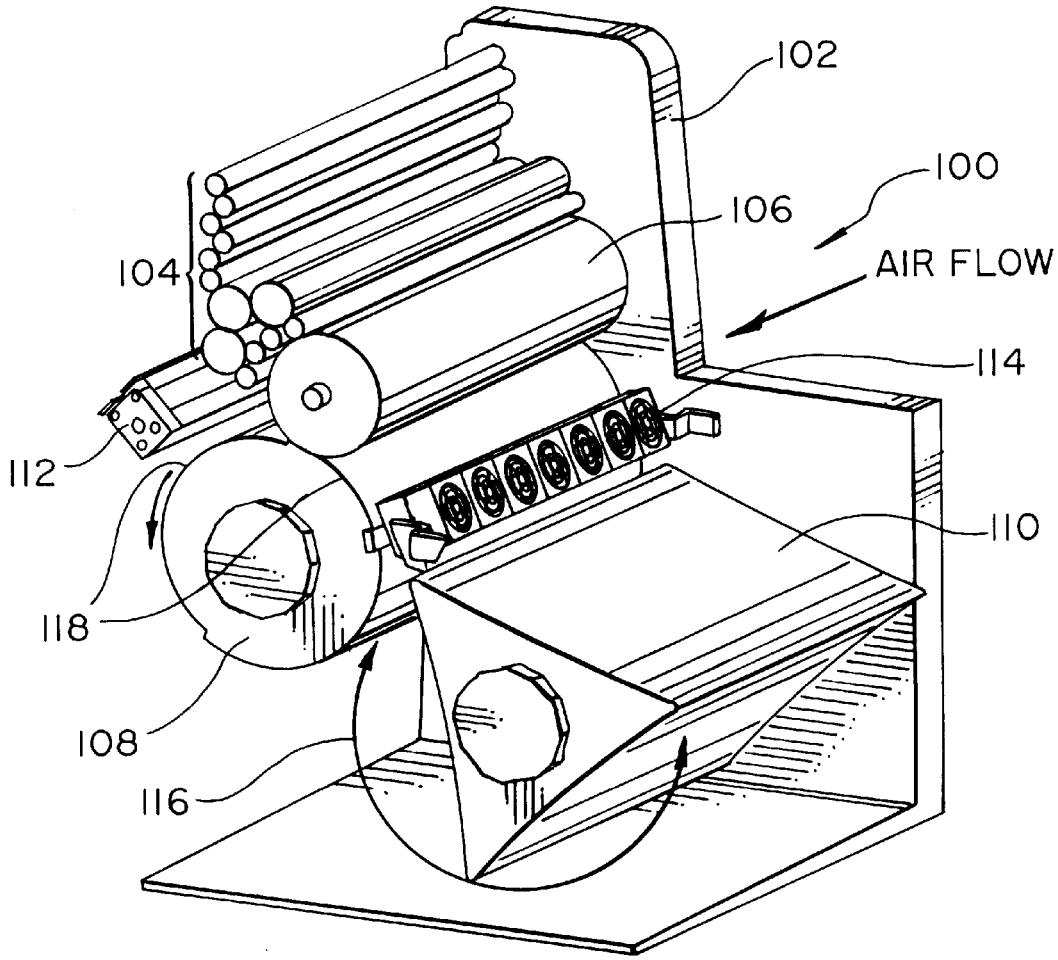
FIG. 1 is a perspective view of a sheet-fed printing press with a radiant curing source and a cooling system of the present invention.

In FIG. 1, an exemplary unit of the printing cylinder assembly of this invention is depicted generally at 100, and includes a support frame 102, a plurality of ink cylinders 104, a blanket cylinder 106, an impression (printing) cylinder 108, a transfer cylinder 110, a radiant source 112, and a cooling unit 114. Only a portion of the support frame 102 is shown in FIG. 1. However, the support frame 102 (and optionally an overhead structure) partially encloses the unit 100 and maintains the ink cylinders 104, blanket cylinder 106, impression cylinder 108, transfer cylinders 110, radiant source 112, and cooling unit 114 in position.

The ink cylinders 104 convey the ink from a reservoir (not shown) to the blanket cylinder 106. The blanket cylinder 106 deposits the ink on the substrate when the substrate is positioned between the blanket cylinder 106 and the impression cylinder 108. The transfer cylinder 110 in this embodiment is depicted as a prism. However, the present transfer cylinder may include any. geometry suitable for transferring substrate sheets. Sheet substrates are conveyed in the direction of arrow 116 by the transfer cylinder 110 and are conveyed in the direction of the arrows 118 by the impression cylinder 108 when the substrate is being printed. Sheet substrates are conveyed away from the impression cylinder 108 by another transfer cylinder (not shown).

After the ink has been deposited on the sheet substrate, the source 112 directs radiant energy (e.g., infrared, ultraviolet) onto the substrate to cure and bond the ink thereto. FIG. 1 shows the source 112 positioned to direct radiant energy at the sheet substrate when the sheet substrate is positioned on the impression cylinder 108. However, the source 112 may also be positioned to direct radiant energy at sheet substrates positioned on other components, such as a transfer cylinder, which conveys the substrate away from the impression cylinder 108.

Figure 2:
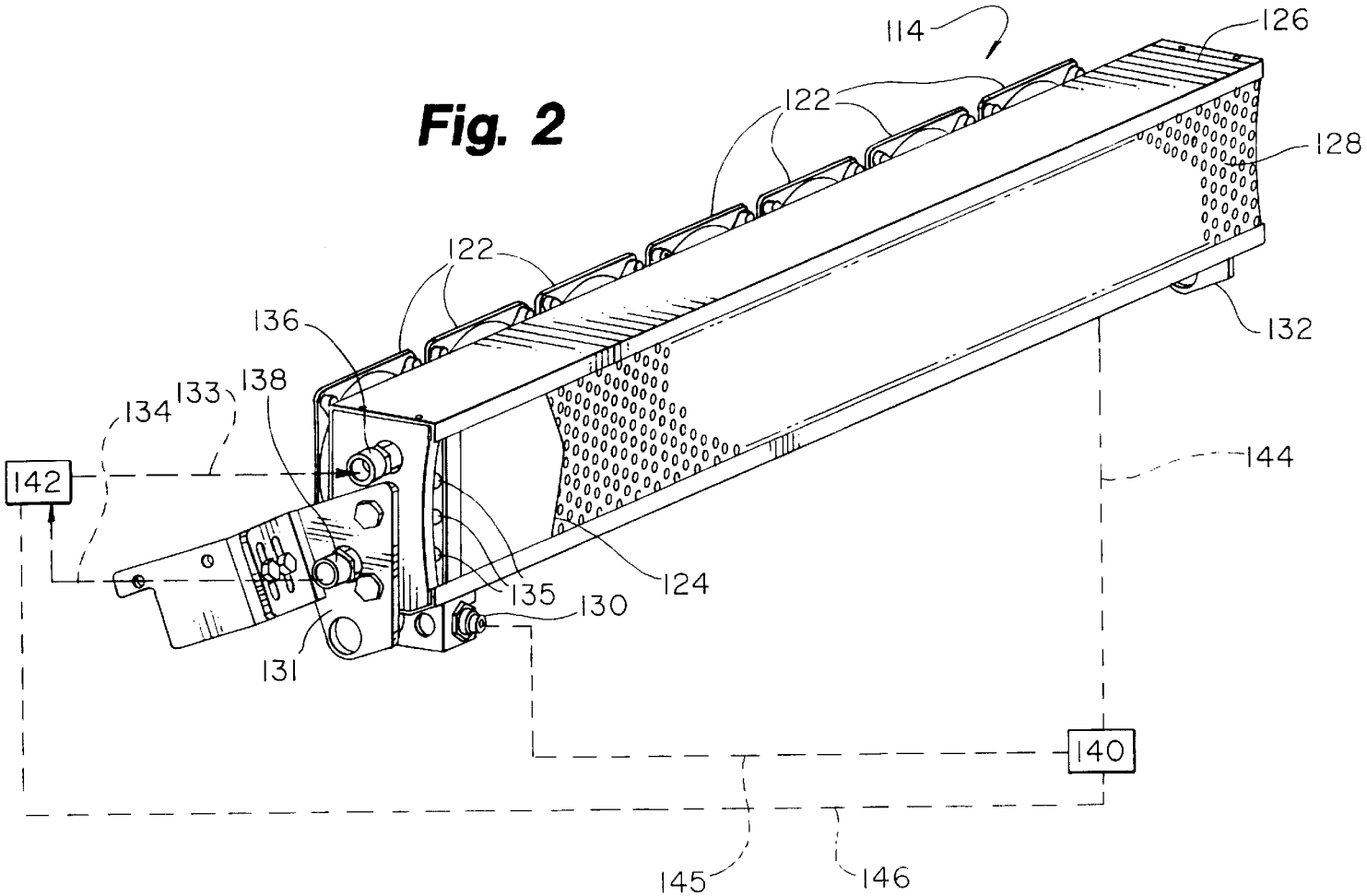
FIG. 2 is a perspective view of the cooling system of FIG. 1.

As shown in FIG. 2, the exemplary cooling unit 114 includes at least one fan 122, a coil assembly 124, a pan 126, a screen 128, at least one sensor 130, and mounting brackets 131 and 132. The fans 122 are mounted to the pan 126 so as to generate an airflow through the coil assembly 124 and screen 128. In this embodiment, the fans 122 push the airflow through the coil assembly 124. However, in other embodiments the cooling unit 114 is configured such that the fans pull air through the coil assembly. By way of illustration and not limitation, the airflow temperature of one suitable embodiment has a temperature between about 50 degrees F. and 55 degrees F. and the airflow is about 350 (±200) cm in magnitude. In one embodiment seven fans are used in one cooling unit. A type of fan known as a "muffin fan" to the art has been used successfully.

The coil assembly 124 includes one or more coils 135 in fluid communication with respective ingress and egress fittings 136 and 138. The ingress and egress fittings 136 and 138 connect to respective coolant lines 133 and 134. The coolant lines 133 and 134, in turn, convey a coolant such as a chilled liquid water (e.g.) between the cooling coils and a pump or valve 142 to (e.g., a solenoid valve). While chilled water is circulated to cool the airflow generated by the fans 122 in this embodiment, it is understood that any mechanism for cooling airflow is within the scope of this invention. A person of ordinary skill in the art would readily understand how to substitute and adapt other cooling mechanisms. One such alternative cooling mechanism uses a compressible gas such as freon as a coolant.

In some embodiments, the airflow temperature generated by the present cooling unit is between about 34 degrees F. and 55 degrees F., between about 34 degrees F. and 50 degrees F., and any range subsumed therein.

The sensor 130 maybe a noncontact infrared sensor. The present sensor modulates the flow of coolant to the cooling coils and activates the fans. The present sensor may be adjustable or may activate at a preset temperature. In this embodiment, the sensor 130 is eclectically connected to the fans 122. However, the present invention may include a controller unit 140 as well. The controller unit 140 may be in electrical communication with the fans 122 (indicated at 144), the sensor 130 (indicated at 145), or pump or valve 142 (indicated at 146). When the sensor 130 detects a predetermined temperature of the impression or transfer cylinder surface, the controller unit 140 actuates the fans 122 and the chilled water supply pump (or opens the valve) 142. The controller unit 140 may further deactivate the fans 122 and the chilled water supply pump (or closes the valve) 142 when the sensor 130 detects a lower predetermined impression or transfer cylinder surface temperature. In yet another embodiment, the controller unit 140 is in electrical communication with several of the present cooling units 114, each cooling unit 114 cooling a different cylinder. Thus, the present controller may control several cooling units to cool several cylinders. These cylinders may be maintained within identical or differing temperature ranges. It is also contemplated that the present controller may include an alarm. The alarm would sound when the cylinder being monitored reaches a predetermined temperature. For instance, if a cylinder being monitored reaches a temperature of 105 degrees F. and the maximum effective transfer element temperature is 100 degrees, the cooling system might be malfunctioning. Therefore, the alarm sound would alert attendants that the cooling system was not operative.

The brackets 131 and 132 are configured to position the present cooling system a desired distance from a transfer element such as the impression cylinder 108 or the transfer cylinder 110, e.g., by being attached to the support frame 102. The present cooling system may be positioned a distance from a transfer element such that the airflow generated by the cooling system will maintain the transfer element within a desired or effective temperature range (discussed below). In some embodiments, the cooling system 114 is positioned such that the screen is between about two and three inches or about two inches from the transfer element.

Some of the radiant energy from the source 112 cures (dries) and bonds the printing medium to the substrate. Another portion of the radiant energy is absorbed as heat by the substrate and the transfer element. After absorbing the radiant energy, the heated substrate is conveyed away from the transfer element. Some of the radiant energy absorbed by the transfer element is radiated to surrounding air. However, the temperature of the transfer element is raised by the remainder of the absorbed radiant energy.

The typical printed image is a mosaic or composite of several component images printed sequentially by printing units such as that depicted in FIG. 1. Thus, a finished printed product will be the result of numerous, sequentially printed component images. Each component image must be printed in an exact relationship to previously and sequentially printed component images. This is usually a routine and easily achieved requirement. However, when transfer elements are heated, heat is transferred to substrates, which are in contact therewith. The heated substrate, in response, distorts, e.g., expands or contracts. The amount of substrate distortion is determined by factors such as the type of material from which the substrate is made and dimensions (e.g., length, width, thickness) of the substrate. Thus, alignment (registration) of component images deviates in relation to both the amount of heat absorbed by the substrate, the type of substrate material, and substrate dimensions. For example, some plastic substrates expand more than others and some paper substrates contract when exposed to heat.

It is thus essential to maintain transfer elements within a temperature range so that substrate distortion, hence deviation from alignment (registry), is within allowable limits. Allowable substrate distortion limits vary depending on factors such as the number of component images present and the colors used. However, in many instances allowable substrate distortion limits are less than 1/1000 inch, less than 1/100 inch, or less than 1/64 inch.

The effective temperature range for transfer elements cooled by the present invention is contemplated to encompass any transfer element temperature which will result in substrate distortion within allowable distortion limits, as discussed hereinabove. In some instances to confine substrate distortion to allowable limits, the present transfer element temperature may be maintained at between ambient air dew point (proximate the transfer element) and 120 degrees F., between a temperature slightly above the ambient dew point (e.g., 2 degrees F. above the ambient dew point) and 120 degrees F., between 60 degrees F. and 120 degrees F., between 90 degrees F. and 95 degrees F., or any range subsumed therein.

Transfer element temperatures are controlled by the temperatures of the airflow generated by the present cooling system. To this end, an effective airflow temperature is contemplated to include any temperature, which will maintain the present transfer elements at a temperature, which will result in substrate distortion within allowable limits. Under certain circumstances substrate distortion is confined to allowable limits when the present airflow temperature is between slightly above freezing (e.g., 34 degrees F.) and 120 degrees F., between 40 degrees F. and 75 degrees F., between 50 degrees F. and 55 degrees F., or any range subsumed therein.

Airflow temperatures are determined by temperatures of water (or other coolants) being circulated within the present cooling coils. In the context of this invention, an effective water temperature is considered to encompass any water temperature resulting in a substrate distortion, which is within allowable limits. Under certain circumstances substrate distortion is confined to allowable limits when the present water temperature is less than the effective transfer element temperature range, slightly greater than freezing (e.g., 34 degrees F.), between 32 degrees F. and 120 degrees F., between 32 degrees F. and 40 degrees F., or any range subsumed therein.

The cooling system of this invention potentially offers a considerable savings in energy costs over previous cooling systems. As noted above, previous cooling systems use ducts to direct air at, and cool, the transfer elements. The air is typically drawn from a single location, often outside the building. When these previous cooling systems aroused, each unit of air directed at transfer elements must first be cooled from ambient temperature, e.g., 80 degrees F., to the desired temperature, e.g., 34 degrees F.

By contrast, the present cooling system generates an airflow using air from inside the printing unit. Because the printing unit is at least partially enclosed by the frame or support, the air is partially contained within the printing unit and, therefore partially recycled. Moreover, because the recycled air within the print unit tends to be cooler than ambient air from outside the print unit, it requires less energy to be cooled to the desired temperature for the airflow.

The present cooling system is also easily retrofitted to almost any sheet-fed press. The cooling units can be configured to fit in the often small spaces available in the printing unit. Moreover, the lines providing power and coolant to the cooling unit can be placed in spaces too small to accommodate the air ducts of the previous systems. Thus, virtually any existing printer can be retrofitted with the present cooling system without out extensive modification and without installing air ducts. Moreover, if printer units are moved, the power and coolant supply lines of the present cooling system are simply disconnected, then reconnected at the new site, whereas air ducts must be dismantled and then reconstructed when previous cooling systems were used.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A sheet-fed printing system, comprising:

a source of printing medium;

a support frame at least partially enclosing the sheet-fed printing system;

a transfer element rotatably supported by the support frame;

a source for directing ultraviolet radiant energy at a substrate being printed with the pointing medium, the source substantially disposed within the support frame and positioned proximate the transfer element, some of the radiant energy absorbed by the transfer element thereby raising a temperature of the transfer element; and a cooling unit configured for generating and directing a cooled airflow onto the transfer element, the cooled airflow maintaining the transfer element within an effective temperature range such that the substrate being printed distorts less than an allowable substrate distortion limit, the cooled airflow substantially generated from air at least partially present within the support frame and previously cooled by the cooling unit.

2. The printing system of claim 1, in which the transfer element is selected from a transfer cylinder and an impression cylinder.

3. The printing system of claim 1, in which the allowable substrate distortion limit is 1/64 inch.

4. The printing system of claim 1, in which the allowable substrate distortion limit is 1/100 inch.

5. The printing system of claim 1, in which the allowable substrate distortion limit is 1/1000 inch.

6. The printing system of claim 1, in which the transfer element temperature is maintained between an ambient air dew point temperature and 120 degrees F.

7. The printing system of claim 1, in which the transfer element temperature is maintained between a temperature slightly above an ambient air dew point temperature and 120 degrees F.

8. The printing system of claim 1, in which the transfer element temperature is maintained between 60 degrees F. and 120 degrees F.

9. The printing system of claim 1, in which the transfer element temperature is maintained between 90 degrees F. and 95 degrees F.

10. The printing system of claim 1, in which the airflow has a temperature between slightly above the freezing point of water and 120 degrees F.

11. The printing system of claim 1, in which the airflow has a temperature between 40 degrees F. and 75 degrees F.

12. The printing system of claim 1, in which the airflow has a temperature between 50 degrees F. and 55 degrees F.

13. The printing system of claim 1, the cooling unit comprising:

at least one fan; and at least one cooling coil conveying a coolant and positioned to cool air directed by the fan at the transfer element.

14. The printing system of claim 13, in which the coolant has a temperature less than the transfer element temperature.

15. The printing system of claim 13, in which the coolant has a temperature between 32 degrees F. and 120 degrees F.

16. The printing system of claim 13, in which the coolant has a temperature between 32 degrees F. and 40 degrees F.

17. The printing system of claim 13, in which the coolant comprises a chilled liquid.

18. The printing system of claim 17, in which the chilled liquid comprises water.

19. The printing system of claim 13, in which the coolant comprises a compressible gas.

20. The printing system of claim 13, further comprising a temperature sensor in electrical communication with the fan, the temperature sensor measuring the transfer element temperature.

21. The printing system of claim 20, in which the temperature sensor comprises an infrared, noncontact sensor.

22. The printing system of claim 20, further comprising a control unit and a pump or valve, the control unit in electrical communication with the sensor, the pump or valve, and the fan and activating the fan and the pump or valve when the transfer element is heated to a designated temperature.

23. The system of claim 22, in which the control unit is configured so that the designated temperature can be set by an attendant.

24. A process for maintaining an operating sheet-fed printer transfer element heated by a source of ultraviolet energy within a designated temperature range, the transfer element at least partially enclosed and supported by a support frame, the process comprising:

providing a cooling unit comprising at least one fan and a cooling coil; and directing an airflow at the transfer element, the airflow cooled by the cooling coil and generated by the fan, at least a portion of the airflow generated from air previously cooled by the cooling unit.

25. The process of claim 24, in which the cooling coil conveys chilled water.

26. The process of claim 24, in which the coil conveys a compressible gas.

27. The process of claim 24, in which the airflow is directed in response to a temperature sensor reading.

28. The process of claim 27, in which a control unit is in electrical communication with the temperature sensor, the fan and a palm or valve circulating coolant through the cooling coil and in which the airflow is initiated by the control unit in response to a reading from the temperature sensor.

29. The process of claim 24, in which the airflow is directed in response to a reading from an infrared, noncontact sensor.

30. A process of installing a cooling system for a sheet-fed printer transfer element heated by ultraviolet radiation, the transfer element supported by a support frame, die support face at least partially enclosing the transfer element, the process comprising:

providing a cooling unit with at least one cooling coil, a fan, and a pump, the fan generating an airflow from air previously cooled by the cooling unit within the support frame, the airflow cooled by the cooling coil, the pump circulating a cooling fluid through the cooling coil; and positioning the cooling unit so as to direct the airflow at the transfer element.

31. The process of claim 30, further comprising electrically connecting a thermal sensor to the fan and the pump.

32. The process of claim 30, further comprising electrically connecting a noncontact, infrared sensor to the fan and the pump.

33. The process of claim 32, further comprising electrically connecting a control unit to the sensor, the fan, and the pump.

34. The process of claim 30, in which the provided pump circulates chilled water through the cooling coil.

35. The process of claim 30, in which the provided pump includes a compressor compressing a compressible gas to be circulated through the coil.

* * * * *